US006763574B1

(12) United States Patent
Woll

(10) Patent No.: US 6,763,574 B1
(45) Date of Patent: Jul. 20, 2004

(54) PROCESSING DEVICE

(75) Inventor: Matthias Woll, Östringen (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/545,471

(22) Filed: Apr. 7, 2000

(30) Foreign Application Priority Data

Apr. 8, 1999 (DE) ..... 199 15 728

(51) Int. Cl.[7] ..... H01R 43/042

(52) U.S. Cl. ..... 29/753; 29/751; 29/755; 29/33 M; 29/748; 29/861; 29/863

(58) Field of Search ..... 29/753, 751, 755, 29/33 F, 33 M, 748, 861, 863, 857

(56) References Cited

U.S. PATENT DOCUMENTS

| | | | |
|---|---|---|---|
| 2,631,213 A | | 3/1953 | Martines |
| 5,404,634 A | | 4/1995 | Takeshita et al. |
| 5,661,897 A | | 9/1997 | Kaneda et al. |
| 5,794,333 A | | 8/1998 | Shea |
| 5,864,947 A | * | 2/1999 | Yamamoto et al. ..... 29/753 |
| 5,970,609 A | * | 10/1999 | Shioda ..... 29/861 |

FOREIGN PATENT DOCUMENTS

| | | |
|---|---|---|
| DE | 1 515 395 | 11/1969 |
| DE | 39 37 029 | 3/1991 |
| DE | 40 01 775 | 7/1991 |
| FR | 1.316.151 | 12/1962 |
| WO | WO 98/07217 | 2/1998 |

OTHER PUBLICATIONS

Patent Abstracts of Japan vol. 009, No. 146 (m–389), Jun. 21, 1985 & JP 60 024232 A (Yazaki Sougiyou KK) Feb. 6, 1985.

* cited by examiner

*Primary Examiner*—Richard Chang
(74) *Attorney, Agent, or Firm*—Kenyon & Kenyon

(57) ABSTRACT

A device for the semi- or fully automatic attaching of a contact element (1) to a cable end (2), including a drive unit (3), a storage unit (4) containing a plurality of contact elements (1), a transport device for feeding contact elements (1) to the cable end (2), and a processing unit (5). At least the processing unit (5) and the storage unit (4) are configured as a self-enclosed assembly (6), which, as a self-enclosed unit, can be separated from the drive unit (3).

9 Claims, 4 Drawing Sheets

PROCESSING DEVICE

FIELD OF THE INVENTION

The invention relates to a device for the semi- or fully automatic attaching of a contact element to a cable end, including a drive unit, a storage unit containing a plurality of contact elements, a transport device for feeding the contact elements to the cable end, and a processing unit.

BACKGROUND INFORMATION

A device of this type is known. The drive unit, the transport device, and the processing unit, in this context, constitute a self-enclosed assembly that is specially refitted to adapt to the specific cable end being processed. In this context, the result is significant operating interruptions of the device. From an economic point of view, this is not satisfactory.

DESCRIPTION OF THE INVENTION

The invention is based on the objective of refining a device of this type such that the result is significantly reduced refitting times for the adaptation to cable ends being processed using contact elements that are different from each other This objective is achieved according to the present invention in a device of the type cited above having the characterizing features of claim 1. The subclaims make reference to advantageous embodiments.

In the device according to the present invention, it is provided that at least the processing unit and the storage unit are configured as a self-enclosed assembly and that the assembly, as a self-enclosed unit, can be separated from the drive unit. As a result, adaptation tasks that may be necessary can be performed outside the device itself. In this way, the device can remain in use until the replacement process is carried out, it being then switched off for a short time to replace the assembly and immediately thereafter placed once again in operation. In this manner, the operational interruptions necessary for a replacement of this type are reduced to an absolute minimum.

The replacement can be effected particularly rapidly, if the drive unit has a distance from a base plate connected to it and if the assembly can be inserted, at least partially, into the gap formed by that distance and if it can be secured on both sides. It is expedient if the gap is standardized with respect to its size and geometric shape and if it is adapted to the assembly. As a result, it is, for example, possible to use quick couplings [bayonet-type couplers] to mount the assembly, which makes possible to carry out the replacement even more rapidly.

The quick coupler can include at least one T-groove of the one part, extending at right angles with respect to the gap, a mushroom head or an extended T-shaped, protruding profile of the other part being insertable into the T-groove. In this context, the parts coming to engage in each other can advantageously be secured by a supplemental clamping device, counteracting any subsequent shifting. With respect to shape, a relatively light construction suffices, because the forces normally to be absorbed are absorbed by the parts that engage with each other, the T-groove and the mushroom head, i.e., parts distinguished by a particular robustness.

It has proven to be advantageous if, in addition, the transport device for the contact elements is integrated into the assembly. As a result, the transport device can, in a specific manner, be adapted to a contact element being used in an individual case, which makes it possible to configure the transport device in an optimal manner and, under certain circumstances, to achieve significantly improved operating reliability. It is therefore also not necessary to design larger and smaller contact elements in a completely uniform manner with respect to certain details, simply in order to be able to use a universal transport device. In addition, integrating the transport device in this manner offers the additional opportunity to detect and to eliminate wear-related problems in the functioning of the transport device, which arise in the preliminary stages of actual use.

In the storage unit, it is possible to accommodate at least one roll of a strip, which contains the contact elements. In this context, the possibility arises of using contact elements that constitute projections of a continuous stamping conveyor belt and that, within the positions of the roll, are separated from each other by a paper strip, in order to prevent them from catching on one another. Of course, it is also possible to use a storage unit that is configured as a hopper for separated contact elements.

The storage unit and the processing unit can be capable of being in greater proximity to each other, while [remaining] separate from the drive unit, in order to reduce the storage and transport volume of the assembly. In this context, the possibility exists to provide for a hinged bearing and/or a sliding connection between the two, for example a sliding sleeve, to achieve in this way a greater proximity between the two.

DESIGN OF THE INVENTION

The invention is further clarified below on the basis of the drawing.

Figure 1:
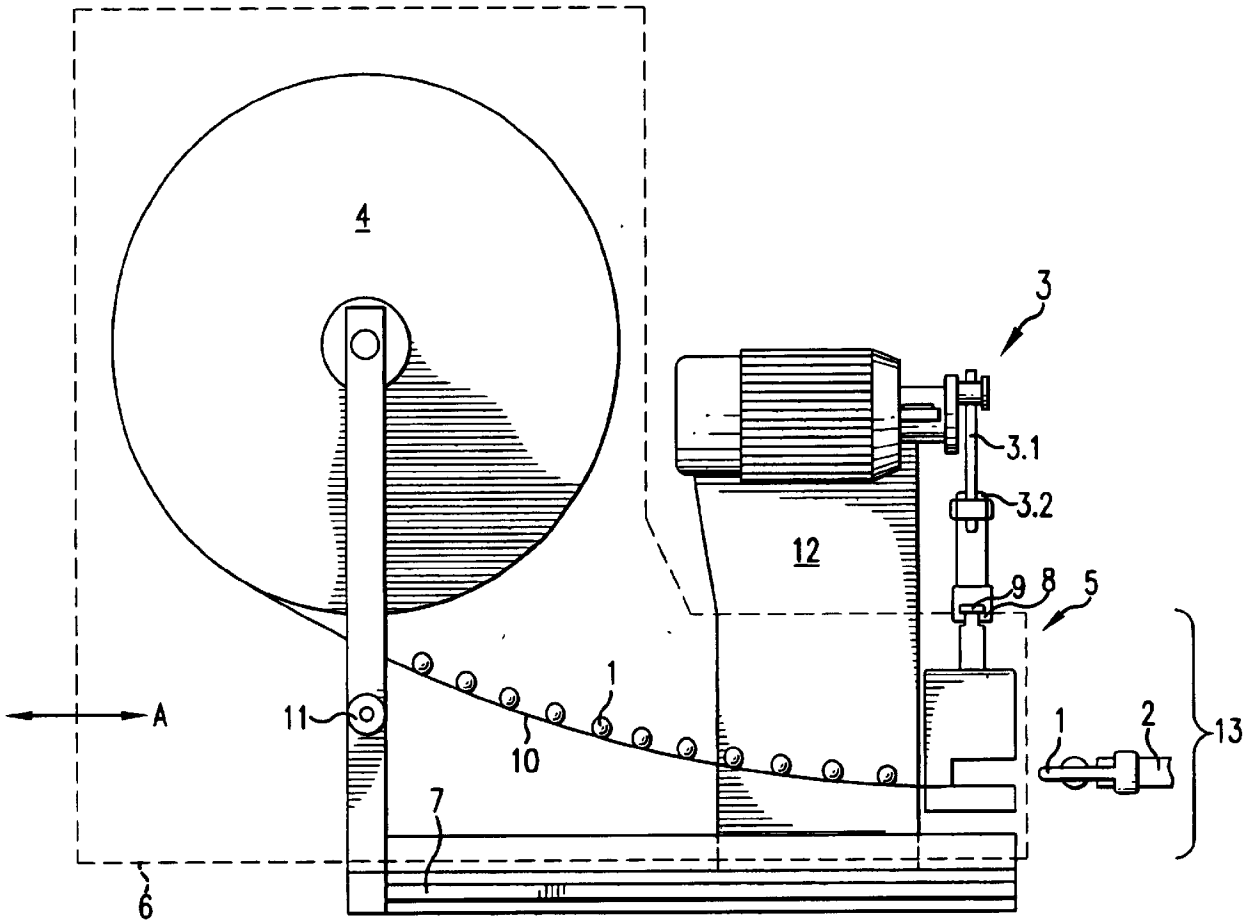
FIG. 1 shows an exemplary embodiment of the device in a view from the front.
Figure 2:
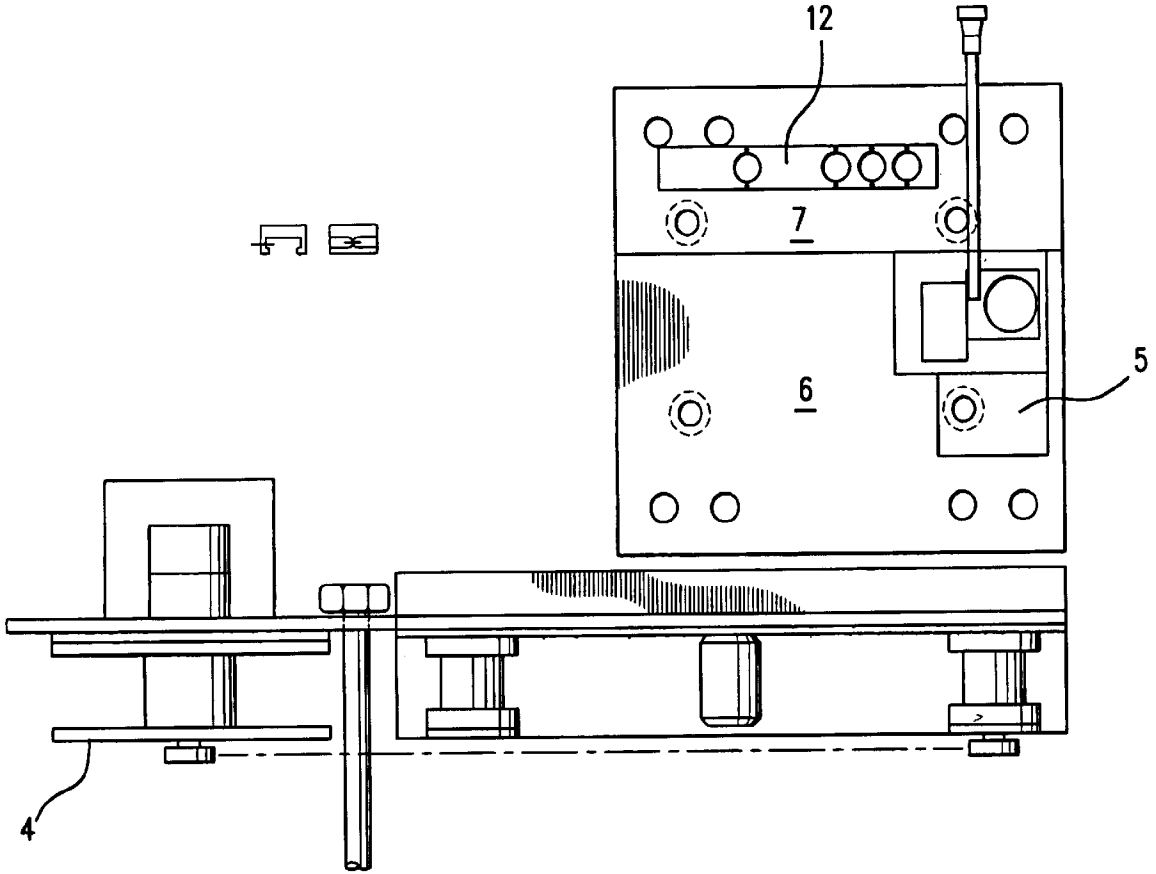
FIG. 2 shows the device from FIG. 1 in a view from above.

The device depicted in FIGS. 1 to 4 are designed for the fully automatic crimping-like attachment of a contact element 1 and a cable end 2. The device includes a drive unit 3, which contains a motor having an eccentric drive 3.1, a power press stamp 3.2 capable of being placed by the drive unit in an up-and-down relative motion with respect to a base plate 7. Drive unit 3 and base plate 7 are joined by a support 12, which is attached on one side. As a result, between the drive unit and base plate 7, a free space or gap 13 is formed that is completely open in the direction of the viewer.

From the direction of the viewer, a self-enclosed assembly 6 is inserted into this free space or gap, the assembly including a storage unit 4 containing a plurality of contact elements 1, a transport device 10 for feeding contact elements 1 to a cable end 2, and a processing unit 5 for the crimping-like attachment of a respective final contact element 1 to the stripped cable end. Processing unit 5 can also be configured to strip the cable end. For the two-sided securing of assembly 6, quick couplers are provided on both sides. They are formed by T-grooves 8 of the one part, extending parallel to the gap, a mushroom head 9 or a projection having a T-profile, of the respective other part, being capable of being inserted into the T-groove. The forces arising in response to the optimal stripping of the cable end during the execution of the crimping-attaching process are essentially absorbed in this way. In order to prevent vibration-induced relative sliding during normal use, supplemental clamping devices are provided, that are not represented in the drawing.

In the configuration depicted in the drawing, a roll of a strip can be taken up in storage unit 4, the strip containing contact elements 1. The latter can be constituted by projections of a continuous stamping conveyor belt, from which individual contact elements 1 are punched out during the crimping process Apart from this, there is the possibility of using already separated contact elements and feeding them to processing unit 5 with the assistance of a subcarrier, for example a conveyor made of paper or plastic. Furthermore, the possibility exists that storage unit 4 be constituted as a hopper for separated contact elements 1. In this case, a transport device for the supply line is provided, that is configured accordingly.

Figure 3:
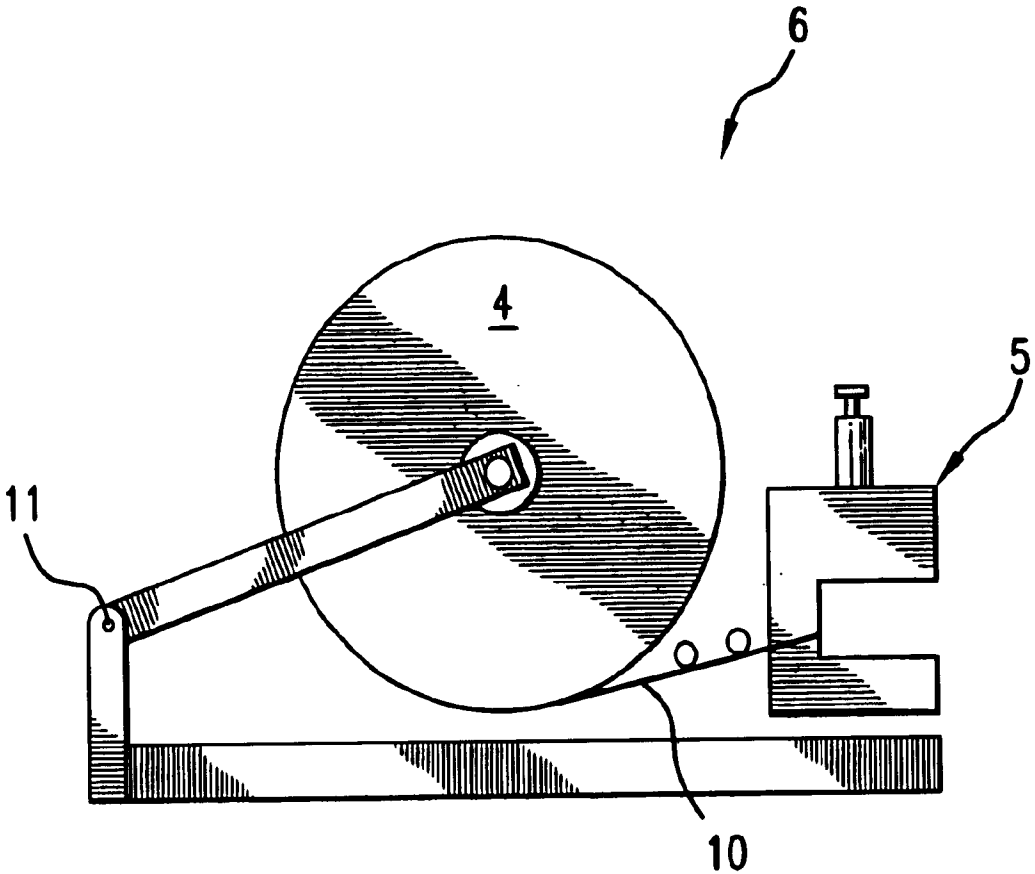
FIG. 3 shows the self-enclosed assembly of the device from FIG. 1 wherein the storage unit and the processing unit have been brought into closer proximity to each other by a hinged bearing.
Figure 4:
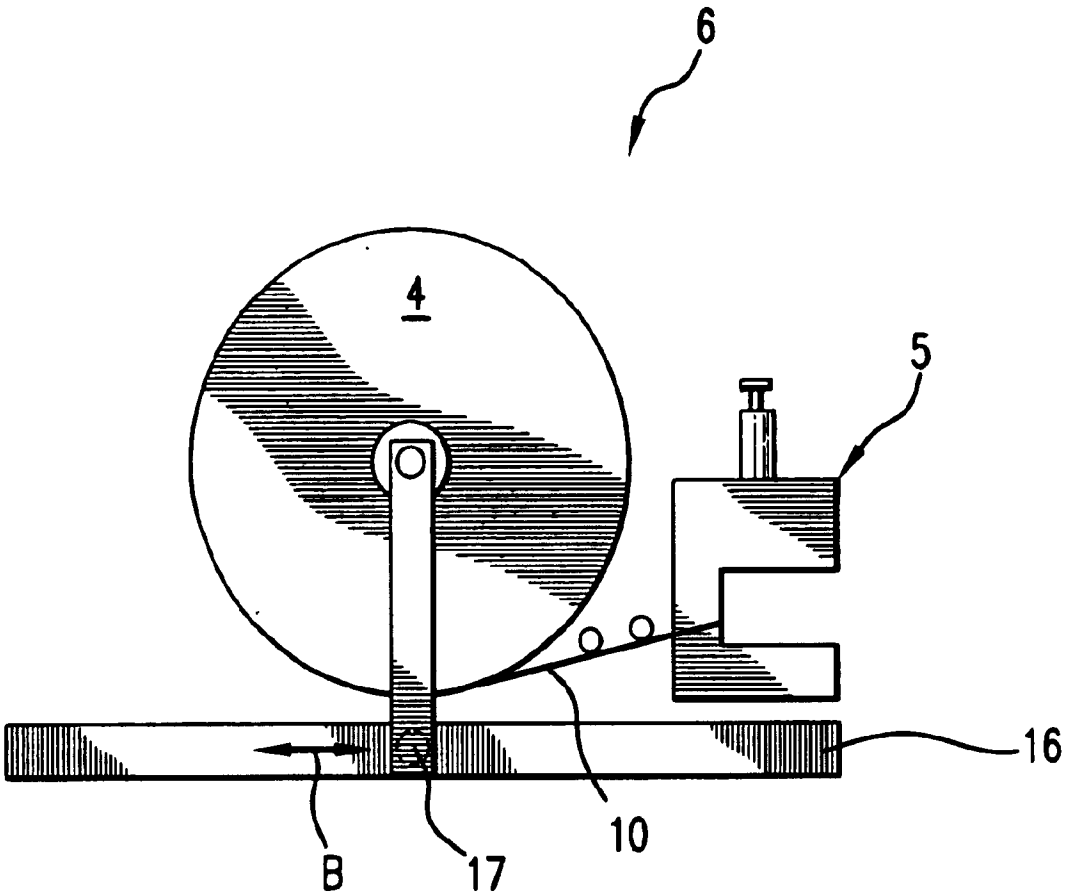
FIG. 4 shows a self-enclosed assembly of another embodiment of the device wherein the storage unit and the processing unit have been brought into closer proximity to each other by the storage unit being slidably connected in the assembly.

Storage unit 4 and processing unit 5, in the design presented in FIG. 1, are joined to each other by a hinged bearing 11, and, through actuating hinged bearing 11, they can be brought into greater proximity to each other, while being separate from the drive unit. The transport and/or storage volume, in this way, can be significantly reduced, which makes the storage function much easier. FIG. 3 shows one embodiment of the device illustrated in FIG. 1, in which the self-enclosed assembly 6 has the storage unit 4 and the processing unit 5 having been brought into closer proximity to each other by a hinged bearing. FIG. 4 shows another embodiment of the self-enclosed assembly 6 wherein the storage unit 4 and the processing unit 5 have been brought into closer proximity to each other by the storage unit 4 being slidably connected in the assembly 6. More specifically, FIG. 4 illustrates one embodiment in which the storage unit 4 has a sliding connection 17 that is slidably connected to a base portion 16 of the self-enclosed assembly, for instance, in a direction shown as arrow B.

The advantages achieved using the device are seen, above all, in the fact that the refitting times heretofore necessary for a refitting are eliminated to the greatest extent possible. From an economical point of view, this is a great advantage.

What is claimed is:

1. A device for the semi- or fully automatic attaching of a contact element to a cable end, including a drive unit, a storage unit containing a plurality of contact elements, a transport device for feeding the contact elements to the cable end, and a processing unit, wherein at least the processing unit and the storage unit are connected to each other as part of a self-enclosed assembly, and wherein the entire assembly, as a self-enclosed unit, is separable from the drive unit such that the processing unit and the storage unit remain connected to each other upon being separated from the drive unit and so as to be replaceable with minimal operational interruption of the device.

2. The device according to claim 1, wherein the drive unit is situated at a distance from a base plate connected to the drive unit, and wherein the assembly is at least partially insertable into a gap defined by the distance and is securable to at least one of the drive unit and the base plate.

3. The device according to claim 1, wherein the assembly is securable by at least one quick coupler.

4. The device according to claim 2, wherein the quick coupler includes:

at least one groove extending parallel to the gap; and an element insertable into the quick coupler.

5. The device according to claim 1, wherein the assembly additionally includes the transport device for the contact elements.

6. The device according to claim 1, wherein the storage unit is configured to accommodate at least one roll of a strip containing the contact elements.

7. The device according to claim 1, wherein the storage unit comprises a hopper for separated contact elements.

8. The device according to claim 1, wherein the storage unit and the processing unit can be brought into closer proximity relative to each other, while separate from the drive unit.

9. The device according to claim 8, wherein the device further comprises at least one of a hinged bearing and a sliding connection for achieving the closer proximity.

* * * * *